United States Patent [19]

Rodrigue

[11] Patent Number: 4,595,075

[45] Date of Patent: Jun. 17, 1986

[54] COLLAPSIBLE LADDER ASSEMBLY

[76] Inventor: Denis Rodrigue, 509 Murray, Greenfield Park, Quebec, Canada, J4V 1N8

[21] Appl. No.: 769,475

[22] Filed: Aug. 26, 1985

[51] Int. Cl.[4] ..... E06C 1/56; E06C 9/14

[52] U.S. Cl. ..... 182/70; 182/198

[58] Field of Search ..... 182/70, 76, 75, 196, 182/197, 198

[56] References Cited

U.S. PATENT DOCUMENTS

| | | | |
|---|---|---|---|
| 288,078 | 11/1883 | Littlefield | 182/70 |
| 369,681 | 9/1887 | Bemish | 182/74 |
| 819,956 | 5/1906 | Thomsen | 182/70 |
| 1,123,029 | 12/1914 | Smith | 182/70 |
| 1,181,667 | 5/1916 | Jaffie . | |
| 1,196,419 | 8/1916 | Banyovits . | |
| 1,753,798 | 4/1930 | Martin | 182/70 |
| 2,946,398 | 7/1960 | McNulty . | |
| 3,677,366 | 7/1972 | Loeffel . | |
| 3,809,181 | 5/1974 | Staranick | 182/70 |
| 3,907,064 | 9/1975 | Svalberg | 182/70 |
| 4,211,306 | 7/1980 | Brenner | 182/76 |
| 4,231,449 | 11/1980 | Laurita . | |

FOREIGN PATENT DOCUMENTS

| | | | |
|---|---|---|---|
| 686130 | 5/1964 | Canada | 182/70 |

OTHER PUBLICATIONS

Advertising brochure entitled: "Safe Escape", distributed by St-Pierre Manufacturing Corp. of Worcester, Mass.

Advertising brochure entitled: "A Safe Escape Ladder", distributed by Exitable of Framingham, Mass.

*Primary Examiner*—Reinaldo P. Machado

*Attorney, Agent, or Firm*—Robic, Robic & Associates

[57] ABSTRACT

Collapsible ladder assembly comprising a ladder storage container having, in closed condition, a fixed upright rear wall, an upright front wall and bottom and top walls joining the front and rear walls, a collapsible ladder being held within the container with its top end secured to the container rear wall. The top wall is made up of a rearward section solid with the rear wall and a frontward section projecting from the front wall, a mechanism releasably locking the top wall sections together. The bottom wall is hinged to the rear wall and to the front wall while the latter is also hinged to the frontward section of the top wall, the hinges allowing the walls to pivot about horizontal parallel axes when the locking mechanism is actuated to release the top wall sections from one another, allowing the container unretained walls and the ladder to unfold downwardly under gravity action.

11 Claims, 5 Drawing Figures

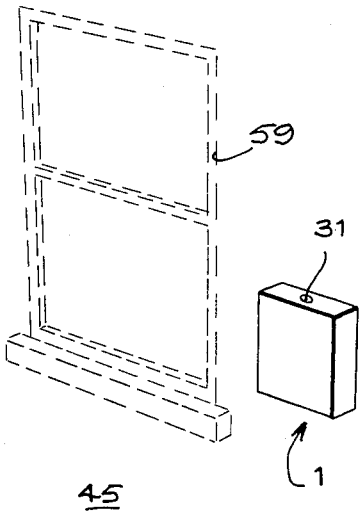
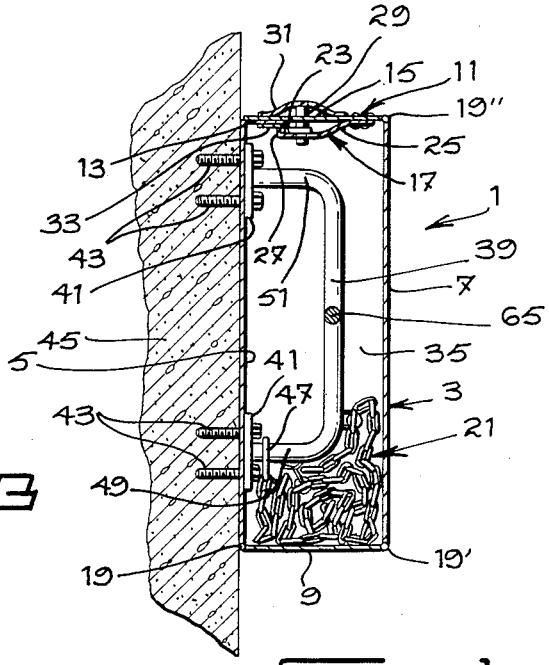
FIG. 3
FIG. 1
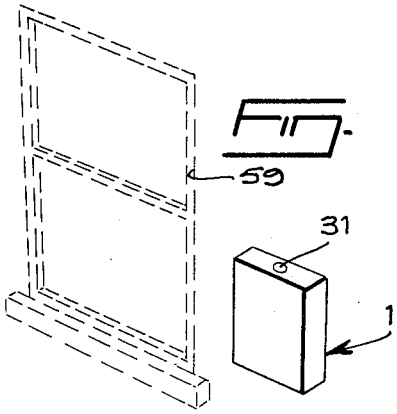
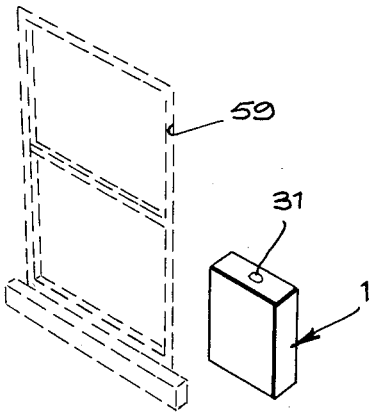
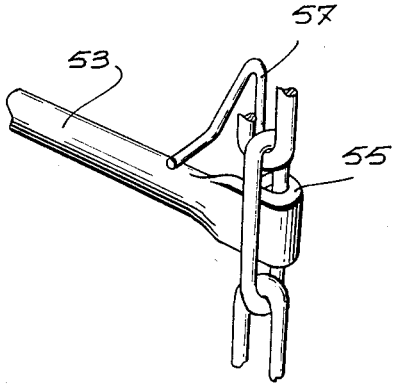
FIG. 5

COLLAPSIBLE LADDER ASSEMBLY

BACKGROUND OF THE INVENTION

The present invention relates to a collapsible ladder assembly, particularly of the type for use as fire escape.

A main object of the invention lies in providing an improved assembly of the above type wherein the ladder can be compactly collapsed and housed within a container which can readily and easily be opened. The improvement resides especially in the construction of the container of which all of the walls, except the rear wall which is fixed, unfold downwardly to hang from the lower edge of the wall following application of a relatively light pressure on a released piston provided at the top of the container.

Another object resides in that the ladder lies, in collapsed condition, on the bottom wall of the container when the latter is closed so that, as the walls unfold downwardly to open position and including the bottom wall, the ladder spreads out immediately into use condition, being retained at the top on the container rear wall, preferably by means of handles secured to the rear wall.

A further object of the invention is that opening of the container and outward spreading of the ladder are accomplished automatically and quickly under the sole action of gravity so that the only work to be done by the user is to apply the aforesaid light pressure on the release piston, no other operation being necessary on his part.

Yet another object of the invention is in the provision of a fire escape installation for use on a building wall having a number of vertically spaced windows, there being one such collapsible ladder assembly of the improved type provided next to each window and the length of the ladders, in spread out condition, being sufficient for a user to use successive ladders as he climbs down the wall, pressing release pistons of downward ladder containers to cause their opening as he reaches them.

A search was made prior to the drafting of the present application, which search has revealed the following U.S. Pat. Nos.:

1,181,667 of 1916
1,196,419 of 1916
2,946,398 of 1960
3,677,366 of 1972
4,231,449 of 1980

While, admittedly, the above patents disclose collapsible ladders housed, in non-use condition, in containers that can be opened in various ways, none discloses a structure affording the advantageous objects mentioned above, more specifically the possibility of providing a container which opens following application of a light pressure on a release piston provided at the top of the container, the opening that immediately follows taking place under the sole action of gravity and spreading of the ladder, from collapsed condition, likewise taking place under the sole action of gravity.

SUMMARY OF THE INVENTION

Achieving the above objects is possible with a collapsible ladder assembly made according to the invention which comprises a ladder storage container having, in closed condition, a fixed rear wall, a front wall and top and bottom walls all being connected at adjoining edges for pivotal movement about horizontal parallel axes. The top wall however is made up of two wall sections of which one is solid with the rear wall and these two sections are releasably interlocked by a locking mechanism which is preferably actuated by a vertically displaceable piston that projects upwardly from the top wall. A collapsible ladder is housed within the container, when closed, having its top end secured to the container rear wall, preferably through being connected to a pair of rod handles themselves having their free ends secured to the container rear wall.

In this manner, when the top wall sections are released from one another, the frontward section of the top wall, the front wall itself and the bottom wall unfold downwardly away from the fixed rear wall by pivoting about the horizontal and parallel axes aforesaid so that they may hang from the lower end of the rear wall.

Such a collapsible ladder assembly is particularly useful in a fire escape installation for use on a building wall having a plurality of windows, equally spaced vertically. In this case, the installation comprises such a collapsible ladder at the level of each window, means being provided for securing each assembly to the building wall in a manner such that the assemblies are disposed in vertical alignment.

A description now follows of a preferred embodiment of the invention, having reference to the appended drawing.

BRIEF DESCRIPTION OF THE DRAWINGS

FIG. 1 is a vertical cross-sectional view of a collapsible ladder assembly, made according to the invention and shown in closed condition of the container;

FIG. 3 is a perspective view of a wall of a building having a plurality of windows and showing one ladder assembly secured thereto next to each window;

FIG. 5 is a perspective view of a detail.

DESCRIPTION OF THE PREFERRED EMBODIMENT

Figure 2:
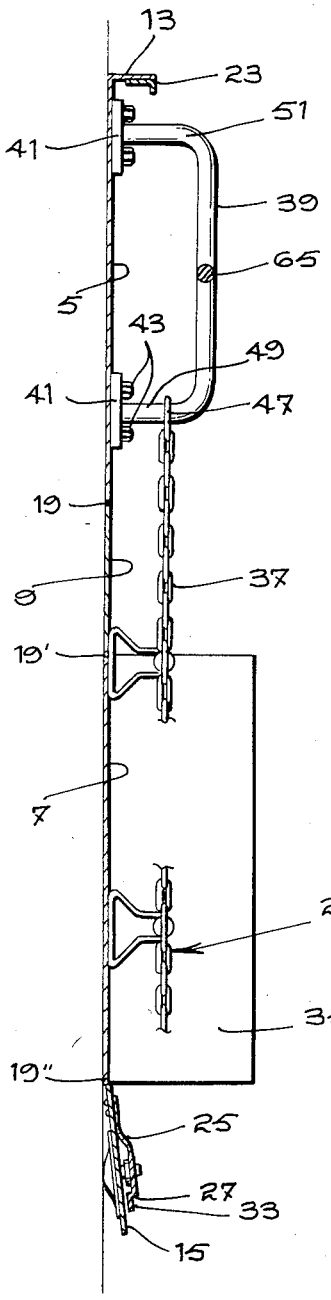
FIG. 2 is a view similar to that of FIG. 1 but showing the container and ladder in open condition.

With reference to FIGS. 1 and 2, the container 3 of the collapsible ladder assembly 1 has a fixed upright rear wall 5, a front wall 7 facing the rear wall 5, a horizontal bottom wall 9 which joins the front and rear walls 7, 5, at their lower ends and a horizontal top wall 11 which joins the front and rear walls 7, 5, at their top ends. As perhaps best seen in FIG. 2, the top wall 11 itself is made up of a rearward section 13, solid with the rear wall 5 such as by being an upper edge which is bent in the direction of the front wall 7, and a frontward section 15 which is joined to the front wall 7 and projects therefrom toward the rear wall 5. Means 17, to be more fully described hereinafter, releasably lock the top wall sections 13 and 15 together to define, in the closed position of the container 3 as shown in FIG. 1, the top wall 11.

Conventional hinges 19, 19' and 19'' respectively join the bottom wall 9 and the rear wall 5; the front wall 7 and the bottom wall 9 and the front wall 7 and the frontward section 15 of the top wall 11, all hinges allowing pivotal movement of the joined parts 9, 7 and 15 about horizontal and parallel axes. With this description in mind, it will be appreciated that, in released condition of the top wall sections 13, 15, by operation of the locking means 17, the frontward section 15, the front wall 7 and the bottom wall 9 will unfold downwardly away from the fixed rear wall 5 by pivoting about the horizontal and parallel axes of the hinges 19, 19', 19'', so as to hang from the lower end of the rear wall 5 as clearly shown in FIG. 2. It will also be appreciated that the operation takes place under the sole action of gravity which includes that of a ladder 21, of the collapsible type, housed in folded or collapsed condition within the container 3 when the releasable locking means 17 lock the two top wall sections 13 and 15 together in the closed condition of the container 3, as shown in FIG. 1. Thus, the weight of the ladder 21 contributes in the gravity action to unfold the container 3. On the other hand, means to be more fully described hereinafter are provided to secure the top end of the ladder 21 to the container rear wall 5.

In the closed condition of the container 3 as shown in FIG. 1, the frontward section 15 of the top wall overlies the rearward section 13.

The aforesaid means 17 for releasably locking the sections 13, 15, together may be of the type comprising a lug 23 downwardly projecting from the free edge of the rearward section 13 and an upwardly biassed locking strip 25 secured at one end 2 and beneath the frontward section 15 and upwardly turned, as at 27, at the other end so that, in the container closed position shown in FIG. 1, it comes in engagement with and behind the lug 23. The locking means 17 further comprises a release piston 29 fixed in any known manner to the locking strip 25 and having one end slidably extending through a suitable aperture across the frontward section 15 so as to project above the frontward section 15. Viewing FIG. 1, it will be appreciated that a slight downward push on the release piston 29 from outside of the container 3 will disengage the upturned end 27 from the lug 23 and cause opening of the container 3 under the weight of the ladder 21 and of the container walls 9, 7, 15.

The aforesaid lug 23 may be a flange of an angle member, as shown in FIGS. 1 and 2.

A waterproofing dome-shaped seal 31 may be provided on the frontward section 15 for housing the projecting end of the release piston 29 and provide suitable protection against rain and snow, seal 31 being made of rubber or the like flexible material.

The locking strip 25 may be a downwardly curved spring blade and the upwardly turned end 27 may extend out into a horizontal lug-butting lever 33 which would be useful in helping the upwardly turned end 27 come into locking engagement with the lug 23 when the container is being closed.

The enclosure defined by the container 3 may be completed by a pair of side walls 35 fixed or otherwise solid with the front wall 7 at opposed edges thereof.

These side walls project of course toward the rear wall 5.

As to the collapsible ladder 21, it has a pair of upright-forming chains 37. The means aforesaid securing the top end of the ladder 21 to the rear walls may comprise a pair of vertically extending laterally spaced rod handles 39 secured in any known manner to the rear wall 5. Prior to this however the end links 47 of the chains 37 are slid around the lower legs 49 of the handles 39.

The handles 39 may, in turn, be secured to the rear wall 5 through flat discs 41 provided at the free ends of the lower and upper legs 49, 51, the discs being then welded to the rear wall 5. Preferably, these discs 41 are formed with suitable holes for the extension therethrough of bolts 43 to be threaded in suitable metal sleeves driven into the building wall 45 over which the ladder assembly 1 is to be mounted.

The ladder 21 has a series of spaced rungs 53 of which the ends are secured to the chains 37, as shown in FIG. 5. The rungs 53 may be round or square bars flattened at their ends and then bent around, as at 55, and secured to one side member of an appropriate link of the chains 37. Spacers 57 of heavy wire material may be fixed at the ends of each of the rungs 53 to hold the ladder 21 at a predetermined distance from the wall 45.

Figure 4:
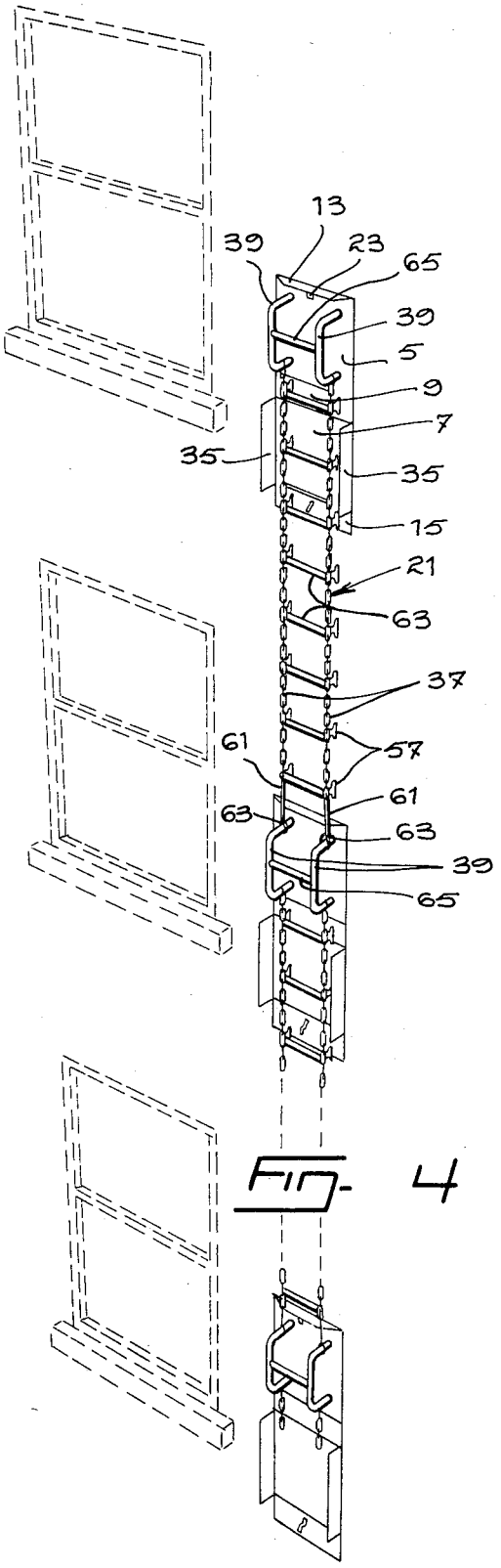
FIG. 4 is a view similar to that of FIG. 3 but showing the assemblies in open condition for use.

The aforedescribed ladder assembly 1 is particularly suited for a fire escape installation such as that shown in FIGS. 3 and 4 which uses a plurality of them in vertical alignment, the assemblies 1 being equally spaced and mounted immediately next to the windows 59 so as to be readily be accessible in case of emergency where all that the user has to do is press down on the seal 31 at the top of each assembly 1, causing immediate opening of the container and stretching out of the chain 21 in the manner described above. He then grabs the handles 39 and then climbs down the ladder 21 as will readily be appreciated from a viewing of FIG. 4.

When used in a fire escape installation of this nature, the chains 21 will have a predetermined length which is essentially equal to the spacing between the windows so that the user may move from one ladder to the next and, in so doing, he can operate the lower ones of the assemblies successively by merely pressing down, by foot, on the seals 31 in succession. To assist in stabilizing the ladders, it is preferable to provide, at the lower end of each ladder 21, a pair of resilient bands 61 having hooks 63 at the free ends thereof while the other end is secured to the lower lihks of the chains 37. Thus, with reference to FIG. 4, once the user has reached the middle one of the assemblies 1 and stand on the corresponding ladder 21, he may secure the upper ladder 21 by stretching the bands 61 and cause engagement of the hooks 63 onto the legs of the handles 39 of the middle ladder assembly. This will of course provide greater confidence for those following him in the fire escape installation by preventing wobbling of the ladder 21 which would happen if it were not for the aforesaid removable stabilizing means 61, 63.

Additional rungs 65 may advantageously join the pairs of handles 39.

I claim:

1. A collapsible ladder assembly comprising:

a ladder storage container having, in closed condition, a fixed upright rear wall, an upright front wall facing said rear wall, a horizontal bottom wall joining said front and rear walls at a lower end of said front and rear walls and a horizontal top wall joining said front and rear walls at a top end of said front and rear walls, said top wall comprising a rearward section solid with said rear wall and projecting toward said front wall and a frontward section joined to said front wall and projecting from said front wall toward said rear wall;

means releasably locking said top wall sections together;

a plurality of means respectively hingedly joining said top wall frontward section and said front wall along adjoining edges thereof, said front wall and said bottom wall along adjoining edges thereof and said bottom wall and said rear wall along adjoining edges thereof, for respective pivotal movement of said joined forward section and said walls about horizontal and parallel axes whereby, in released condition of said top wall sections, said frontward section of said top wall, said front wall and said bottom wall unfold downwardly away from said fixed rear wall by pivoting about said horizontal and parallel axes so as to hang from said lower end of said rear wall;

a collapsible ladder housed, in collapsed condition, within said container when said releasable locking means lock said top wall sections together in said closed condition of said container, and means securing a top end of said collapsible ladder to said container rear wall, wherein said frontward section of said top wall is formed with a through aperture and overlies said rearward section in closed condition of said container, and wherein said means releasably locking said sections together comprise: a lug downwardly projecting from the free edge of said rearward section; an upwardly biassed locking strip secured at one end to and beneath said frontward section and upwardly turned at the other end in engagement with said lug and behind said lug with respect to said one end; and a release piston fixed to said locking strip and having one end slidable through said aperture to project above said frontward section, constructed so that downward pushing on said piston from outside of said container disengages said upturned end of said locking strip from said lug and causes opening of the container.

2. An assembly as claimed in claim 1, further comprising a waterproofing seal, on said frontward section, housing said projecting end of said released piston.

3. An assembly as claimed in claim 1, wherein said locking strip is a downwardly curved spring blade and said upwardly turned end thereof extends out into a horizontal lug-butting lever for use in helping said upwardly turned end come into locking engagement with said lug in closing said container.

4. An assembly as claimed in claim 1, further comprising container sidewalls solid with said front wall and projecting toward said rear wall.

5. An assembly as claimed in claim 1, wherein collapsible ladder has a pair of upright-forming chains each having an end link and wherein said means securing said top end of said ladder to said rear wall comprise a pair of vertically extending laterally spaced rod handles secured to said rear wall, and wherein said end links of said chains are slid around the rods of said handles.

6. An assembly as claimed in claim 5, wherein said ladder further comprises spaced rungs having ends secured to said chains and spacers fixed at the ends of each of said rungs and extending perpendicular therefrom to hold said ladder at a predetermined distance from a wall on which said container is to be secured.

7. A fire escape installation for use on a building wall having a plurality of windows, equally spaced vertically; said installation comprising, for each window, a collapsible ladder assembly as claimed in claim 1 and means for securing each assembly to the building wall next to said windows so that said assemblies are in vertical alignment.

8. An installation as claimed in claim 7, wherein said collapsible ladder of each of said assemblies has a pair of upright forming chains each having an end link and wherein said means securing said top end of said ladder to said rear wall comprise a pair of vertically extending laterally spaced rod handles secured to said rear wall, and wherein said end links of said chains are slid around the rods of said handles.

9. An installation as claimed in claim 8, wherein said chains have a predetermined length substantially equal to the spacing between said windows so that a user may move from one ladder of one of said assemblies to another ladder of another of said assemblies located below said one of said assemblies.

10. An installation as claimed in claim 9, further comprising: means for removably joining the lower end of the ladder of one assembly to the rod handles of an assembly immediately below said one assembly.

11. An installation as claimed in claim 10, further comprising, for each of said assemblies, a transverse rung secured to and between said rod handles, centrally thereof.

* * * * *